US005678981A

United States Patent [19]

Dunham

[11] Patent Number: 5,678,981

[45] Date of Patent: Oct. 21, 1997

[54] METHOD TO CONTROL SUCKER ROD PUMP

[75] Inventor: Cleon Leslie Dunham, Houston, Tex.

[73] Assignee: Shell Oil Company, Houston, Tex.

[21] Appl. No.: 535,439

[22] Filed: Sep. 28, 1995

[51] Int. Cl.[6] ..... F04B 49/00

[52] U.S. Cl. ..... 417/18; 417/53; 73/151; 166/250.01

[58] Field of Search ..... 417/18, 53; 73/151; 166/250.01

[56] References Cited

U.S. PATENT DOCUMENTS

| | | | |
|---|---|---|---|
| 4,490,094 | 12/1984 | Gibbs | 417/53 |
| 4,509,901 | 4/1985 | McTamaney et al. | 417/18 |
| 4,583,915 | 4/1986 | Montgomery et al. | 417/26 |
| 5,006,044 | 4/1991 | Walker, Sr. et al. | 417/12 |
| 5,167,490 | 12/1992 | McKee et al. | 417/18 |
| 5,224,834 | 7/1993 | Westerman et al. | 417/12 |
| 5,237,863 | 8/1993 | Dunham | 73/151 |
| 5,252,031 | 10/1993 | Gibbs | 417/53 |
| 5,314,016 | 5/1994 | Dunham | 166/250 |
| 5,362,206 | 11/1994 | Westerman et al. | 417/12 |
| 5,372,482 | 12/1994 | London et al. | 417/12 |
| 5,423,224 | 6/1995 | Paine | 73/855 |

*Primary Examiner*—Timothy Thorpe
*Assistant Examiner*—Xuan M. Thai
*Attorney, Agent, or Firm*—Del S. Christensen

[57] ABSTRACT

A method is provided to monitor operation of a sucker rod pump, the sucker rod pump having a strain gauge mounted on a walking beam for determination of load. This method compensates for gradual changes in load due to temperature drift when gradual changes in surface card area are occurring and the surface card area or the measured average loads are within a range of a predetermined base surface card area or base average load. When the surface card area or the measured average load is not within this predetermined range, a correction is made to adjust a smoothed minimum load to an adjusted buoyant weight of the sucker rod string. This adjusted buoyant weight is the value that the smoothed minimum load would be expected to be. This algorithm therefore compensates differently for changes in load when the surface card area (or alternatively, the average load) are not within a predetermined value because these changes are generally not due to temperature changes, but due to changes in the operation for which the sucker rod pump monitoring and control system should respond. An alternative correction to the measured load is also provided for time periods when the sucker rod pump is idle.

16 Claims, 1 Drawing Sheet

FIG.
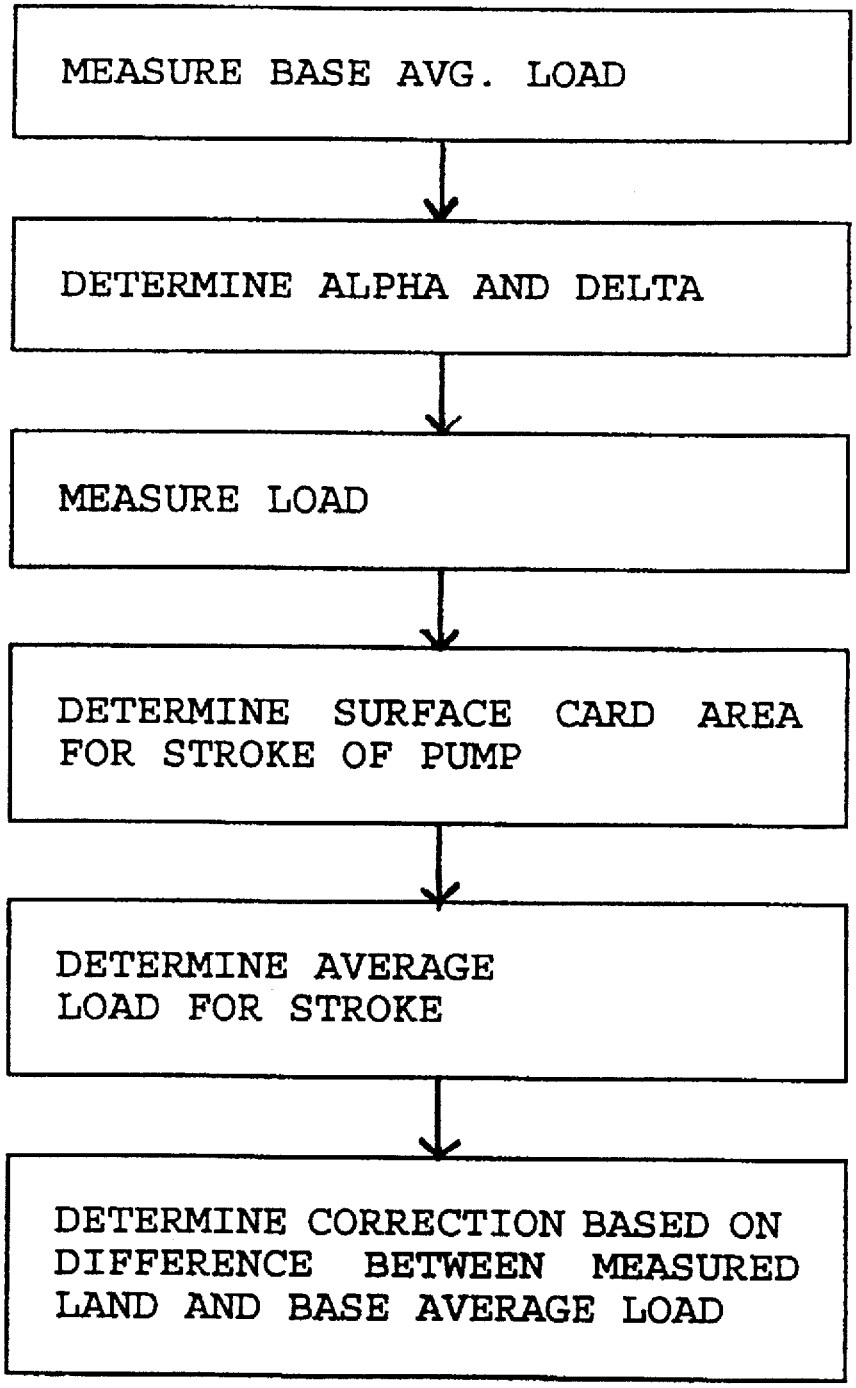

METHOD TO CONTROL SUCKER ROD PUMP

FIELD OF THE INVENTION

This invention relates to an improved method to monitor sucker-rod pumping unit operation.

BACKGROUND TO THE INVENTION

Oil is often produced from wellbores by sucker rod pumps. These pumps are reciprocating pumps driven from the surface by pumping units that move a polished rod up and down through a packing gland at a wellhead. The polished rod extends, via a sucker rod string, to a cylinder above, below, or in a portion of an oil producing strata. The sucker rod string is connected to a plunger within the cylinder, the plunger including a checkvalve allowing liquids to pass upward through the valve but not downward. This check valve is referred to as a traveling valve. A second check valve is located at the bottom the cylinder that allows liquids to enter the cylinder but not leave the cylinder in the downward direction. The second check valve is referred to as a standing valve. Raising the polish rod therefore lifts the plunger, draws liquids into the cylinder through the standing valve, and lifts the cylinder contents above the plunger up through a tubing string toward the surface. The down stroke of the polish rod lowers the plunger, allowing the contents of the cylinder below the traveling valve to pass through the valve to above the traveling valve.

Sucker rod pumps are relatively simple units, but are generally expensive to provide and maintain. Repair of seals around the plunger, standing valve, or traveling valve require lifting of the entire down-hole unit by the sucker rod or tubing string to the surface. This is often a mile or more of sucker rods or tubing that must be lifted and disassembled by one or two twenty five or thirty foot long section at a time. Power requirements of the sucker rod pump are also not insignificant, and are greatly effected by the efficiency at which the unit is operating.

Sucker rod pumping units are typically designed to pump slightly more than the well can produce, because the marginal additional cost of a larger sucker rod pump is negligible compared to the time value of money realized by producing oil from the well at a faster rate. Sucker rod pumps therefore eventually run out of liquids to pump, and draw gas into the cylinders through the standing valves, a condition known as running pumped off. Running pumped off is very detrimental to the service life of the unit. Abnormal conditions of sucker rod pump operation can be detected by accurate monitoring of the pump operation. These abnormal conditions include, for example, running pumped off, and stuck or broken valves. Early detection of these problems can often minimize the cost of maintenance.

Numerous methods have therefore been proposed to monitor and control sucker rod pump operation. Many of these are commercially available. One class of methods to monitor sucker rod pump operation includes methods to monitor work performed, or something that relates to work performed, as a function of polish rod position. This information can be used to determine, for example, if the liquids are pumped off, or if valves are leaking or stuck, and can provide data useful in trouble shooting a wide variety of other problems. A plot of position vs. load measured at the surface, for a normally operating pump, is a generally rectangular plot. The area inside of this rectangle is proportional to the work being performed. Many pump off controllers utilize a plot such as this to determine when the sucker rod pump is pumped off, and then shutdown the pump for a time period when a criteria indicating the pump is off suction is reached. Criteria that have been suggested include load at a fixed position in the downstroke, maximum load, and area inside of the rectangle (often referred to as the surface card area).

U.S. Pat. Nos. 5,006,044, 5,362,206 and 5,372,482 disclose methods to monitor electric motor power consumption as an indicator of work being performed by the sucker rod pump. Accurate measurement of power consumption requires relatively expensive instrumentation, and a more direct measurement would therefore be desirable.

U.S. Pat. Nos. 5,224,834, 5,237,863, 5,252,031, and 5,314,016 disclose various method to monitor and control sucker rod pumps using a strain gauge either located on the polish rod or on the beam of a beam pumping unit as an indicator of load. A common shortcoming of the beam-mounted strain gauges is the inability of the strain gauges to differentiate between strain caused by load on the beam or metal and strain caused be changing temperature of the metal. This problem is particularly noticeable when the strain gauge in mounted on the beam rather than the polish rod. The beam is otherwise a convenient place to mount the strain gauge for reasons that include less movement of the conduits to the gauge, and less need to remove the gauge when maintenance is performed on the pumping unit. The apparent load of the plot of load vs. position will therefore change do to variables such as temperature.

U.S. Pat. Nos. 4,583,915 and 5,423,224 suggest apparatus and methods to temperature compensate strain gauge measurements for changes in temperature. Both of these patents suggest methods that essentially zero-out changes in a measured parameter over a long time period so that slow drifts will be compensated out of the strain gauge output, whereas major changes will not immediately be compensated out, thus permitting the monitoring and control system to function without significant drift due to temperature changes. Because these systems eventually zero out all changes, the absolute level of load is never known, and even the load relative to a datum is not known. Further, these methods generally select one load measurement to hold constant. The maximum load, minimum load, and average load have all been used, and each has disadvantages. Generally, the maximum load will vary at the start of a pump off cycle, but be more consistent near the end of the cycle. The end of the pump off cycle is when it is most important to have reliable information to know if criteria for shutting down the pump is reached, but it would also be desirable to have accurate load compensation at the beginning of the pump cycle.

It would therefore be preferable to better distinguish, over a long time interval, between changes in load caused by temperature variations, and changes in load caused by other factors.

It is therefore an object of the present invention to provide a method to correct a strain gauge output for gradual changes, such as changes in temperature, wherein gradual changes are differentiated from larger changes that are not likely to be caused by variable such as temperature changes.

SUMMARY OF THE INVENTION

This and other objects are achieved by a method to monitor apparent measured loads of a sucker rod pump, the sucker rod pump having a strain gauge mounted on a walking beam for determination of load and having a means for determining a surface card area for each pump stroke, the method comprising the steps of:

measuring a base average load, and base surface card area;

determining a margin, δ, around a base load within which the load at the strain gauge can vary, and a change in surface card area, α, that is an amount that the surface card area can change around the base surface card area while the sucker rod pump is operating normally;

measuring over the course of a pump stroke a measured load, the measured load being an uncorrected measured load plus a correction, the correction calculated as a sum of corrections accumulated from previous pump strokes;

determining for each pump stroke a surface card area using the measured load wherein the measured load is a sum of previous corrections and the load indicated by the strain gauge;

determining for each pump stroke an average load for that stroke; and determining a correction for use in calculation of measured load for subsequent pump strokes for pump strokes using substep (a) when the surface card area is within α of base surface card area, and using substep (b) if the surface card area is not within α of the base surface card area, wherein (a) comprises setting the correction for the present stroke to zero if the measured load is within δ of the base average load, and, when the average load is not within the δ of the base average load, setting the correction for the present stroke to a number that is essentially proportional to the difference between the measured load and the base average load, and (b) comprises determining a smoothed minimum load, determining the difference between the smoothed minimum load and the adjusted buoyant weight, and setting the correction for the present stroke to a number that is proportional to the difference between the smoothed minimum load and the adjusted buoyant weight.

The method of the present invention compensates for gradual changes in load measurements when normal pumping operations are indicated by surface card area, or alternatively, average load. Such gradual changes include changes due to changing temperatures. When surface card area (or alternatively, average load) indicates that the sucker rod pump is not operating in a normal pumping mode, a different algorithm is used to compensate for apparent changes in load because it is anticipated that changes in the load measurements, although likely to occur, will be due to factors other than temperature. During times when the sucker rod pump is not operating in a normal pumping mode, the minimum load is slowly corrected, and corrected by adjusting the correction factor to drive a smoothed minimum load toward the adjusted buoyant weight of the rod string (i.e., the value the minimum load would be expected to be).

Both surface card area and average load are relative constant during times of normal operation, and are less susceptible to peaks and valleys in load measurements than, for example, maximum or minimum loads. When the surface card area or average load (or other independent input) indicate that the sucker rod pump is not in a normal pumping mode, a smoothed minimum load is corrected to an adjusted buoyant weight of the sucker rod pumping string. By more slowly correcting for changes to the minimum load during this time period, changes indicative of other root causes are more readily identified. Further, this adjusted buoyant weight is the value that the minimum load is expected to be, and therefore will tend to cancel out accumulated corrections that may have caused the measured load to drift from its actual value.

BRIEF DESCRIPTION OF THE FIG.

The FIGURE is a process flow diagram for the practice of the present invention in a preferred embodiment.

DETAILED DESCRIPTION OF THE INVENTION

Hardware for practice of the present invention is commercially available. Many sucker rod pumps are presently equipped with pump off controllers that include programmable logic that can be modified according to the present invention. Others are tied to computer monitoring and control systems that can be modified to function according to the present invention. Programmable RTUs that can be programmed according to the present invention are available from, for example, Automated Electronics of Casper, Wyo..

The temperature compensation according to the present invention is preferably applied when a strain gauge, or load cell, is mounted on a walking beam of a sucker rod pumping unit. A load cell could be mounted on the polish rod, in which case temperature compensation is not as important. The temperature of the polish rod will not vary to the extent the temperature of the walking beam can vary. Some strain gauges are internally temperature compensated, and if such a temperature compensated strain gauge is utilized, use of the present invention is not preferred.

The present invention requires that certain variables be determined for a normal cycle of the particular sucker rod pump for which the present invention is to be practiced. These variables include the base surface card area, and the base average load. These variables are preferably determined using an accurate load cell attached to the polish rod because of the increased accuracy that can be achieved by such a strain gauge. These variables are determined by monitoring at least one complete cycle of the pump. If the pump does not pump off, but reaches an equilibrium where flow into the well equals the volume of liquids being pumped, then base values are values at this equilibrium. If equilibrium values are used, it is preferable that, if the well were to begin pumping off, that the control system alert an operator of the change, and that these variables be determined with the pump pumping off.

It is preferable that other variables be determined when the above required variables are determined. For example, a minimum base load and a maximum base load might be determined by a test over at least one pump off cycle. These minimum and maximum loads may be used as additional criteria for determining that the pump is pumping in a normally pumping mode.

In addition to variables that must be determined based on observation of a pump cycle, certain parameters must be selected. These parameters are referred to herein as adjusted buoyant weight, α, and δ. These variables are a margin, δ, around a base load within which the load can vary due to variables such as temperature of the beam at the strain gauge, and a change in surface card area, α, which represents an amount of area that the surface card area may change around the base surface card area while the sucker rod pump is operating normally. The adjusted buoyant weight is the weight of the sucker rod and pump plunger supported by the polished rod with the tubing full of the well's fluids, adjusted for damping and drag effects. This would be equal to the average of the loads on the downstroke, below the point of fluid pound, if fluid pound exists.

The change in surface card area, α, is generally between about one and about ten percent of the surface card area, and preferably about five percent of the surface card area. When the sucker rod pump is started up after being shut down for a long time period, the wellbore annulus may have an untypically high fluid level. This high liquid level provides a net lower head for the liquids being pumped. The work performed by the pump will therefore be relatively low, and the surface card area would be relatively small. The base surface card area minus α will generally be greater than the surface card area at this time. The loads will change upon such a start-up at a rate that will likely exceed changes in load caused by temperature changes or other changes for which compensation is desired. Likewise, when the pump is nearly pumped off, loads will start decreasing due to vapor in the tubing string, and the surface card area will be less than the base surface card area.

An alternative adjustment is therefore utilized when the surface card area is less than the base surface card area minus α or greater than the surface card area plus α. The alternative adjustment is not a temperature compensation, an adjustment that is used only to move the minimum load to the value it is expected to be, i.e. the adjusted buoyant weight of the rod string. This adjustment is preferably a relatively gradual adjustment so that other variations in the measured load will not be totally compensated out of the measured values. This adjustment can be made to be gradual by using a smoothed minimum load, and by adjusting the load by only a proportion of the difference between the smoothed minimum load and the adjusted buoyant weight of the rod string.

A different factor α can be applied above the base surface card area as opposed to below the base surface card area, but applying different factors is not preferred.

An acceptable algorithm to determine a smoothed minimum load is:

$$SML_i = aML_i + (1-a)SML_{i-1} \quad (1)$$

where:

$SML_i$ is the smoothed minimum load for the present stroke, $SML_{i-1}$ is the smoothed minimum load for the previous stroke, $L_i$ is the minimum load measured for the present stroke, and a is a constant between zero and one.

The constant a is preferably between about 0.1 and about 0.5.

Other algorithms may also be used, such as averaging the measurements of the last n cycles where n is a number between two and twenty, preferably between five and fifteen.

The correction factor that is added to subsequent load measurements to correct the smoothed minimum load back to the adjusted buoyant weight of the rod string is preferably about 0.1 to 0.5 of the difference between the smoothed minimum load and the adjusted buoyant weight of the rod string. This adjustment could be made with a standard PID control algorithm, and within the meaning of the terms herein, the correction using such a PID control algorithm would be essentially proportional to the difference between the adjusted buoyant weight and the smoothed minimum load. When a PID control algorithm is used, it is preferably tuned to have a PID proportional control factor of about 0.01 and a PID reset factor of 1000. This would be a very gradual adjustment of the correction to cause the minimum load to approach the adjusted buoyant weight of the rod string.

The margin around a base average load, δ, within which the load can vary (during normal pumping) due to variables such as temperature of the beam at the strain gauge is generally between about one and about ten percent of the base average load. About five percent of the base average load is preferable. A smaller δ results in a larger number of smaller adjustments being made to the base load to compensate for variations in temperature. In the practice of the present invention, when the surface card area is within α of the base surface card area, an adjustment is made to correct for temperature when the measure load is not within δ of the base average load.

A different factor δ can be applied above the base average load as opposed to below the base average load, but applying different factors is not preferred.

During the initial pumping stroke after the sucker rod pump has been shutdown, the adjustment for temperature compensation of the present invention is preferably not made. Further, if an unusual condition is detected, such as the pump being in a pump-off mode but not yet shut down, the temperature compensation of the present invention is preferably not made, regardless of the surface card area or average load value measured, but the alternative correction is made. The temperature compensation of the present invention is most preferably only made if it is apparent to the monitoring system that the pump is operating in a normal mode, within the normal range surface card area. Thus, only the temperature would be expected to vary the load during this mode of operation. When the mode of operation is not this normal mode, the load is expected to vary due to other variables, and temperature effects will be both relatively minor and be inseparable from these other factors.

Thus, a step in the practice of the present invention is to determine if a temperature compensation is to be made based on the measured load for that particular pump stroke. This determination is made by consideration of whether any indication exists that the pump cycle is not a normal cycle (such as being the initial stroke upon start-up or the well being pumped-off), and whether or not the surface card area is within α of the base surface card area. If these conditions exist, an adjustment for temperature compensation is allowed.

A variation of the present invention is to use a smoothed average load rather than surface card area as the criteria to determine if the adjustment for temperature compensation is allowed. In this variation, α can be the change in smoothed average load, and is generally between about one and about ten percent of the smoothed base average load. Use of a smoothed average load rather than the measured load is preferred because of variations in measured loads. Many smoothing algorithms are available, and the choice of any particular algorithm is not critical. An acceptable algorithm is:

$$SL_i = aL_i + (1-a)SL_{i-1} \quad (2)$$

where:

$SL_i$ is the smoothed average load for the present stroke, $SL_{i-1}$ is the smoothed average load for the previous stroke, $L_i$ is average load measured for the present stroke, and a is a constant between zero and one.

The constant a is preferably between about 0.1 and about 0.5.

If an adjustment for temperature compensation is allowed, the difference between the measured load and the base load is determined, and if the absolute value of the difference exceeds δ, an adjustment is made. The adjustment is made by calculating a correction factor to be added to the measured load on the subsequent stroke of the pump. The correction factor is preferable the correction factor used on the present stroke (zero for the initial stroke after start-up) a factor that is proportional to the difference between the average measured load and the base average measured load. This adjustment could also be made with a standard PID control algorithm, and within the meaning of the terms herein, the correction using such a PID control algorithm would be essentially proportional to the difference between the base average load and the smoothed average load. When a PID control algorithm is used, it is preferably tuned to have a PID proportional control factor of about 0.01 and a PID resent factor of 1000. This would be a very gradual adjustment of the correction to cause the smoothed minimum load to approach the base average load.

The measured load, as referred to herein, is the uncorrected measured load plus any correction applied based on previous strokes.

When the sucker rod pump monitoring system is provided with an input to indicate that the pump is idle, an idle adjustment to the measured load is preferably made. This adjustment differs from the either of the adjustments made while the pump is operating. When the pump is idle, the correction to the measured load is preferably made by a) determining that the load has stabilized and then b) setting the correction so that the idle load remains at essentially the same value until the pump restarts. Determining that the load has stabilized is preferably accomplished by taking load measurements at intervals of, for example, one second, and determining that the load has stabilized when a series of, for example three, most recent load measurements are within a limit such as one percent of a previous series of, for example three, load measurements. This determination is most preferably made after the pump has been idle for a minimum period of, for example, ten seconds, to ensure that the load has in fact stabilized to an idle load.

I claim:

1. A method to monitor apparent measured loads of a sucker rod pump, the sucker rod pump having a strain gauge mounted on a walking beam for determination of load and having capability to determine a surface card area for each pump stroke, the method comprising the steps of:

measuring a base average load, and base surface card area;

determining a margin, δ, around a base load within which the load at the strain gauge can vary, and a change in surface card area, α, that is an amount that the surface card area can change around the base surface card area while the sucker rod pump is operating normally;

measuring over the course of a pump stroke a measured load, the measured load being an uncorrected measured load plus a correction, the correction calculated as a sum of corrections accumulated from previous pump strokes;

determining for each pump stroke a surface card area using the measured load wherein the measured load is a sum of previous corrections and the load indicated by the strain gauge;

determining for each pump stroke an average load for that stroke; and determining a correction for use in calculation of measured load for subsequent pump strokes for pump strokes using substep (a) when the surface card area is within α of base surface card area, and using substep (b) if the surface card area is not within α of the base surface card area, wherein (a) comprises setting the correction for the present stroke to zero if the measured load is within δ of the base average load, and, when the average load is not within the δ of the base average load, setting the correction for the present stroke to a number that is essentially proportional to the difference between the measured load and the base average load, and (b) comprises determining a smoothed minimum load, determining the difference between the smoothed minimum load an adjusted buoyant weight, and setting the correction for the present stroke to a number that is proportional to the difference between the smoothed minimum load and the adjusted buoyant weights.

2. The method of claim 1 further comprising a step of resetting the accumulated corrections to zero if the pump stroke is the first stroke since being shutdown.

3. The method of claim 1 wherein the correction is limited to a number that is greater than or equal to the adjusted buoyant weight minus the smoothed minimum load.

4. The method of claim 1 wherein δ is between about one and about ten percent of the base load.

5. The method of claim 1 wherein α is between about one and about ten percent of the surface card area.

6. The method of claim 5 wherein α is about five percent of the surface card area.

7. A method to monitor apparent measured loads of a sucker rod pump, the sucker rod pump having a strain gauge mounted on a walking beam for determination of load and having capability to determine a surface card area for each pump stroke, the method comprising the steps of:

measuring a base average load;

determining a margin, α, around a base average load within which the load at the strain gauge can vary while the sucker rod pump is operating normally and a margin, δ, around the base average load within which the load at the strain gauge can vary, α being a larger number than δ;

measuring over the course of a pump stroke a measured load, the measured load being an uncorrected measured load plus a correction, the correction calculated as a sum of corrections accumulated from previous pump strokes;

determining for each pump stroke an average load using the measured load wherein the measured load is a sum of previous corrections and the load indicated by the strain gauge; and determining a correction for use in calculation of measured load for subsequent pump strokes for pump strokes using substep (a) when the average load is within δ of base average load, and using substep (b) if the average load is not within δ of the base average load, wherein (a) comprises setting the correction for the present stroke to zero if the average load is within δ of the base average load, and, when the average load is not within the δ of the base average load, setting the correction for the present stroke to a number that is essentially proportional to the difference between the average load and the base average load, and (b) comprises determining a smoothed minimum load, determining the difference between the smoothed minimum load and an adjusted buoyant weight, and setting the correction for the present stroke to a number that is proportional to the difference between the smoothed minimum load and the adjusted buoyant weights.

8. The method of claim 7 further comprising a step of resetting the accumulated corrections to zero if the pump stroke is the first stroke since being shutdown.

9. The method of claim 7 wherein the correction is limited to a number that is greater than or equal to the adjusted buoyant weight minus the smoothed minimum load.

10. The method of claim 7 wherein $\delta$ is between about one and about ten percent of the base load.

11. The method of claim 7 wherein $\alpha$ is between about one and about ten percent of the surface card area.

12. The method of claim 11 wherein $\alpha$ is about five percent of the surface card area.

13. The method of claim 1 further comprising the steps of: determining if the sucker rod pump is idle; and when the sucker rod pump is idle, calculating the correction as a number that, when added to the sum of the previous corrections, causes the measured load to remain essentially constant.

14. The method of claim 13 wherein the steps of calculating the correction when the sucker rod pump is idle is performed only after the measured load, measured as about a three-second average, has not changed by more than about one percent between consecutive three-second intervals.

15. The method of claim 7 further comprising the steps of: determining if the sucker rod pump is idle; and when the sucker rod pump is idle calculating the correct as a number that, when added to the sum of the previous corrections, causes the measured load to remain essentially constant.

16. The method of claim 15 wherein the steps of calculating the correction when the sucker rod pump is idle is performed only after the measured load, measured as about a three-second average, has not changed by more than about one percent between consecutive three-second intervals.

* * * * *